United States Patent [19]

Bibi-Roubi et al.

[11] 3,960,375

[45] June 1, 1976

[54] ELEMENT FOR USE IN MAKING A PLAYING SURFACE

[76] Inventors: Albert Bibi-Roubi; Robert Bibi-Roubi, both of 24 rue de l'Ourcq, 77 Fresnes-sur-Marne, France

[22] Filed: Apr. 14, 1975

[21] Appl. No.: 567,888

[30] Foreign Application Priority Data

Apr. 18, 1974 France ..... 74.13560

[52] U.S. Cl. ..... 272/3; 273/29 R; 404/35; 404/41

[51] Int. Cl.[2] ..... A63B 61/00; A63B 71/02

[58] Field of Search ..... 404/41, 40, 36, 35; 273/73 R, 29 R; 52/581, 100, 665; 272/3

[56] References Cited

UNITED STATES PATENTS

| | | | |
|---|---|---|---|
| 2,025,815 | 12/1935 | Horridge | 404/41 |
| 2,327,640 | 8/1943 | Hendry | 52/581 X |
| 2,653,525 | 9/1953 | McGuire | 404/35 |
| 2,680,698 | 6/1954 | Schnee | 404/35 |
| 3,438,312 | 4/1969 | Becker | 272/3 |
| 3,732,020 | 5/1973 | Judge | 404/36 X |
| 3,802,144 | 4/1974 | Spica | 404/41 X |
| 3,868,798 | 3/1975 | Spica | 404/41 X |

*Primary Examiner*—Nile C. Byers
*Attorney, Agent, or Firm*—Flynn & Frishauf

[57] ABSTRACT

An element for use in making a playing surface, particularly an out door tennis court. The element is, for example, a square of 10 cm side, two sides having hooks and two having loops. A series of elements can be laid side-by-side with a hook of one element engaging a loop of another. The hook and loop provide for contiguous location of the elements while allowing for slight movement between the elements. Thus, the elements can expand in hot weather and contract in cold weather without adversely affecting the playing surface.

The element has a cellular structure. Each cell has inclined faces converging towards an aperture. The inclined faces of adjacent faces come together towards the top along a line which forms an intangible upper plane. The lines have a rounded crest. Thus, rain which falls on the playing surface will run down the inclined faces and drain through the apertures of the cells leaving the playing surface free of rain water.

11 Claims, 4 Drawing Figures

ELEMENT FOR USE IN MAKING A PLAYING SURFACE

The present invention relates to an element for use in making a playing surface and in particular to a playing surface for an out door tennis court.

The rebound of the ball on a tennis court should be sufficient and regular. It has, however, been ascertained that out door surfaces formed of contiguous coupled elements of fairly rigid plastics material expand during hot weather and cause local swelling which results in an uneven surface. The court cannot then be used.

An object of this invention is to overcome the above disadvantage by providing an element for making a playing surface of contiguous distinct elements coupled to one another by male and female coupling parts ratched one within the other provided respectively on the two mutually facing sides of two contiguous elements, characterised in that the female part is a loop projecting laterally relative to one side of the element on which it is provided and with the axis of its opening perpendicular to the plane of the facing, the main part of a hook unitary with the other element being engaged with lateral play from above in the loop, while the bent part of the hook is caught below the loop.

Thus, the elements are held together but are able to be displaced laterally with respect to one another so that the disadvantageous effects of expansion are eliminated. Preferably, however, the larger dimension of each element does not exceed 20 cm in order that the play between elements due to the play of the main part of the hook in the loop is efficacious without having to be too large. Generally each element is a square of about 10 cm side, easy to stock.

To avoid as much as possible a discontinuity between the elements forming the playing surface, notwithstanding the capability of taking up the expansions, it is preferable that a membrane, facing the bottom of the loop and extending perpendicular to the plane of the facing or playing surface, extends close to the edge of the side from which the loop extends. In other words, the membrane is not at the interior of the element but at its end. Likewise, it is preferable that only the curved part of the hook projects from the side of the element which carries the hook, the main part being flush with the side of this element. In a general manner, the construction is such that the spacing between the sides of contiguous elements is as slight as possible.

Advantageously the membrane is sufficiently thin to be elastically deformable so that lateral play between the hook and the loop may be increased by this deformation in case of need without this play being very important at normal times.

Preferably, a part at least of one of the coupling parts extends from the lower face of the element at the same height as support legs of the element.

It is desirable to be able to play on a tennis court even when it is raining. For this purpose it is necessary that the water be evacuated immediately in order that the court does not become slippy, in order that the ball does not become saturated and is not made heavy, and in order that the rebound of the ball is not altered as a result of its falling on a spot whether or not it includes a drop of water. To this end, the invention provides a tennis court the playing surface of which is cellular, characterized in that the lateral faces of the cells are inclined and come together toward the top along lines which extend in an intangible upper plane, the crest of the lines being rounded.

It has been ascertained that the relatively fine crest lines do not affect the rebound of the ball even though it would have been thought that the lateral faces of the cells would make up surfaces causing deviations.

The fact that the internal and external faces of the lateral walls of the cells are constituted respectively by two inclined faces coming together towards the top along a crest line considerably enhances the flow of rain water below the structure between the lower face and that of the ground surface. It is easily understood that even very small droplets will not lie on the crest lines of said lateral walls of the cells, but will run down one or other of the two inclined faces and flow downwards under the effect of gravity and possibly under the effect of capillary forces; consequently, it has been found that the crest lines remain at all times practically dry even when there is heavy rain, such atmospheric conditions being then no more susceptible to causing a loss of adherence of players' feet on the upper surface of the structure.

Consequently, in dry or wet weather, the fact that the upper surface of the structure is constituted by an intangible plane containing all the crest lines of the cells avoids any slipping by the players, even when a phase of the game leads them into a position at the limit of unbalance, given that the soles can at all times perfectly grip on the edges or crest lines which constitute the extreme upper part of the lateral walls of the cells.

Of course, there are provided cells which are sufficiently small in order that the walking or running of a player on the playing surface takes place as easily as on standard surfaces of hard material such as "quick," and above all in order that rebounds of the ball take place without irregular deviation, that is to say, as rebounds on a hard and even surface, on beaten earth, etc. However, the dimensions of the cells should not be too small in order that the abovementioned anchorage is always efficacious. It has been ascertained that to fulfil these different conditions, the cells should have an opening of the order of about 10 mm.

In accordance with a particular arrangement of the invention, it has been proved advantageous to provide the crest lines of the lateral walls of one and the same cell in the form of a regular polygon, especially of hexagonal form.

As the cells are regularly distributed over the whole surface of the structure, each of the said lateral walls is common to two adjacent cells.

It is also necessary that the court does not wear away and that it is not dangerous for a player having the habit of touching the ground with one knee when he makes a backhand return, because sharp or frayed crest lines could be cutting. It has been determined that the drops of water break up even if the crests are rounded, provided that their dimension along the intangible upper plane is less than 0.4 mm and preferably included between 0.2 and 0.4 mm. An embodiment of the invention is described hereinafter, by way of non-limitative example, with reference to the figures of the accompanying drawing, in which:

Figure 1:
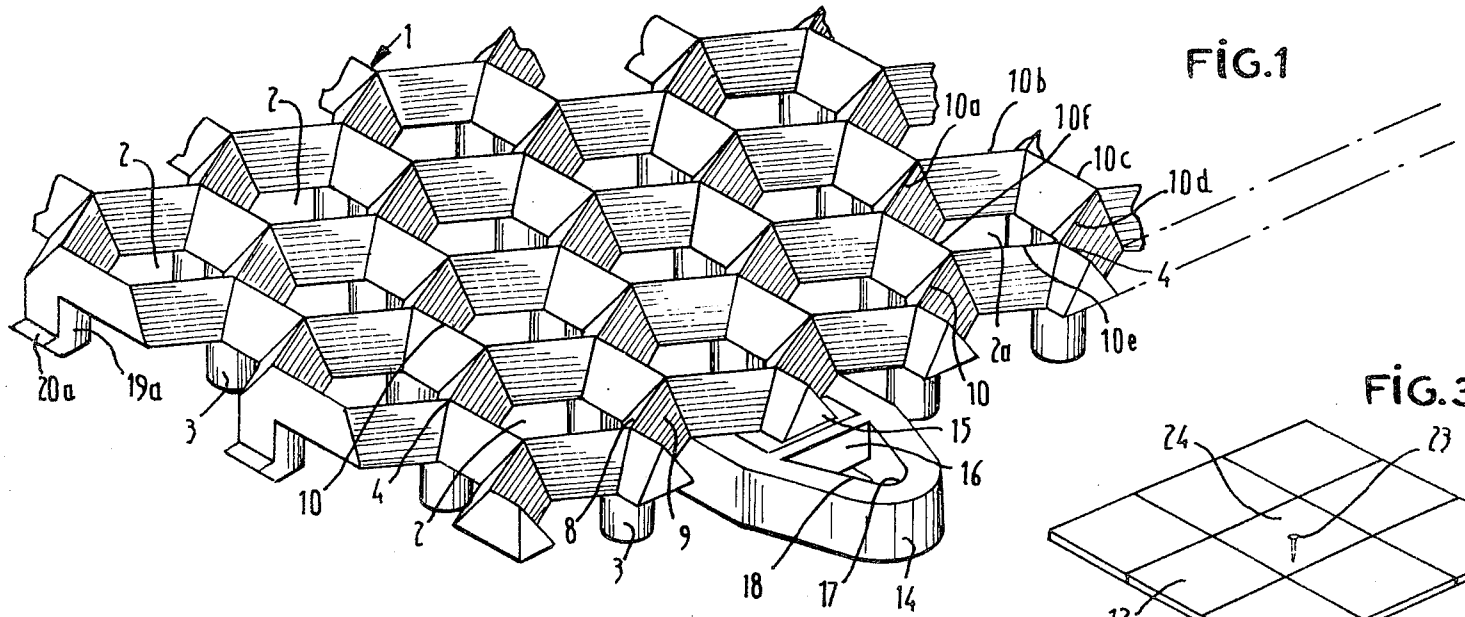
FIG. 1 is a fragmentary perspective view from one corner of a ground facing element according to the invention.

The playing surface of which certain parts have been represented in the figures and which is intended, for example, to constitute a surface for an out door tennis court, includes an element 1, generally flat in form, traversed from one side to the other by cells 2 regularly distributed over the whole surface; this element includes on the under side support legs 3 extending downwardly from at least some of the solid or nodal parts 4 of the element, and adapted to rest on the ground 5 to support the element 1 in such a way that a space 6 is provided between the lower face 7 of the structure and the ground. This space thus permits a flow of rain water below the element and confers some flexibility to the latter, it being understood that in accordance with a preferred embodiment of the invention, it is formed of a plastics material, for example of polyethylene. This material may, moreover, contain at least one hydrophobic substance and at least one substance adapted to impede or decrease the effect ultraviolet rays on the coloration of the element.

In accordance with the invention, the internal and external faces 8 and 9, respectively, of each lateral wall 8, 9 of the cells 2 are respectively constituted by two faces inclined in a contrary direction to one another at the same angle relative to a perpendicular to the general plane of the element 1, i.e., in actual fact, relative to the vertical. The inclined faces 8, 9 meet at the top along the crest lines 10 extending along the same intangible plane of the element (not represented, but which may be defined in the sectional view of FIG. 2 by the line 11). The crest lines 10*a*, 10*b*, 10*c*, 10*d*, 10*e* and 10*f* of the lateral walls of one and the same cell such as 2*a* (FIG. 1) present the shape, seen in plan, of a regular hexagon. Thus, when it is viewed from above the element presents the form of a honeycomb.

Figure 3:
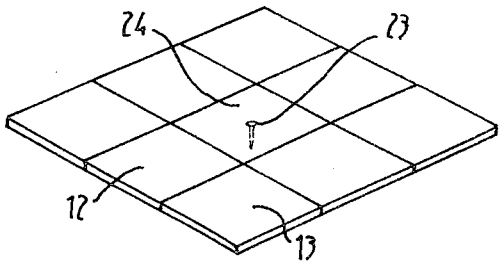
FIG. 3 is a perspective view of a portion of a ground facing according to the invention, containing nine elements generally square in shape, coupled with one another.

In accordance with another important characteristic of the invention, two contiguous elements of the playing surface such as the two elements 12 and 13, represented in perspective in FIG. 3, are coupled together, their two adjacent sides being provided for this purpose, respectively, with a female coupling part and a male coupling part. The partial sectional view of FIG. 2 may be considered to show respectively female and male coupling parts of the element 12 and of the element 13.

The female coupling part of the element 12 is constituted by a loop 14 projecting laterally with respect to the side face 15 of the element, the axis of the opening in the loop extending perpendicularly to the general plane of the element 1. This loop may be considered to be that which is seen in perspective in FIG. 1. The loop 14 includes an elastic membrane 16 moulded in one piece with the loop, just as with the entire element and with the support legs, this membrane delimiting with the bottom 17 of the loop a passage 18 for the male part associated with the structural element 13. The male part is constituted by a hook comprising a shank 19 which can occupy with play the space or passage 18 provided between the elastic membrane 16 and the bottom 17 of the loop, and includes at its free end a curved part 20 adapted to bear against the underside of the membrane 16 after elastic deformation of the membrane when the hook 19, 20 is introduced into the passage 18. Seen in the perspective, the hook 19, 20 has a shape such as can be seen at 19*a*–20*a* in FIG. 1.

Figure 2:
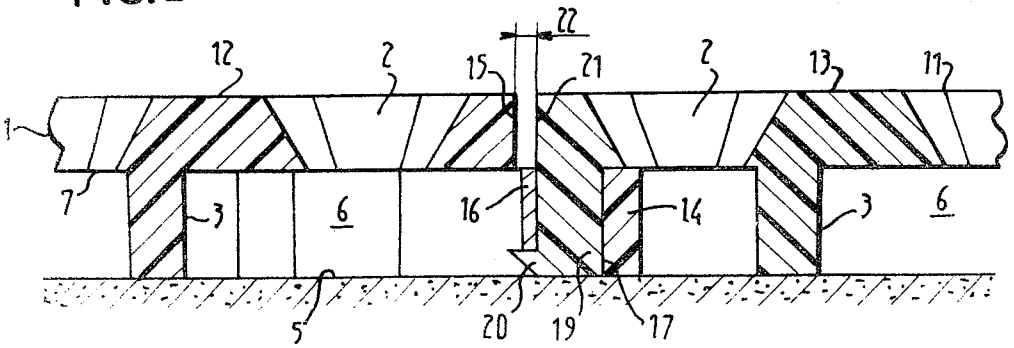
FIG. 2 is a part sectional view of two respective adjacent sides of two adjacent elements on a level with their coupling parts.

The loop 14 with its membrane 16 as well as the hook 19, 20 are positioned respectively with regard to the side face 15 of the element 12 and side face 21 of the element 13, in such a way that a slight spacing 22 is provided between the side faces 15 and 21 all along the latter and along the whole thickness of the element 1. As can be seen in FIG. 2, the loop 14, as well as the shank 19, extend from the lower face 7 of the element 1 along the same depth as the support legs 3. In this way, the shank 19 and the loop 14 constitute in some way the supplementary support legs of the element 1 on the ground, close to the side faces such as 15 and 21 of each pair of adjacent elements such as 12 and 13. As can be seen in FIG. 3, these elements have advantageously a square shape.

Each group of nine elements, such as 12, 13 is fixed on the ground 5 by a peg 23 extending through the central element 24 and driven into the ground. Thus, the eight elements, such as 12, 13 which surround the central element 24, can be slightly displaced with respect to the latter on the occurence of variations in the ambient temperature, while the central element 24 remains fixed.

When the temperature increases, the elements 12 and 13 are displaced due to expansion, and the shank 19 exerts on the elastic membrane a force directed in the opposite direction from the bottom 17 of the loop 14; the width of the spacing 22 slightly decreases. When the temperature decreases, the elements 12 and 13 contract and the elastic membrane 16 pushes back the shank 19; the element 13 moves slightly away from the element 12 and the width of the spacing 22 increases. It is thus determined that the variations in temperature do not subject the elements such as 12 and 13 to any longitudinal constraint; no force has the tendency, especially when the temperature increases, to cause lifting of the elements with respect to the ground, as has occurred in elements of the prior art, in which, on the contrary, at least along a part of the thickness of the structure the sides such as 15 and 21 of two contiguous elements such as 12 and 13 are joined.

During rain, the water streams along the different inclined faces 8, 9 of the lateral walls of the cells and flows on to the ground in the space 6. Given that the material constituting the elements is a plastics material containing at least one hydrophobic substance, the capillary forces are reduced and the water has very little tendency to remain on the faces 8, 9. The droplets which fall directly on the crest lines 10 cannot dwell and flow down one or the other of the inclined faces 8, 9, being entrained by capillarity by the water which flows on the faces. In this way, the upper surface of the structure which extends along a plane such as that defined by the line 11 in FIG. 1, is always dry, and the players can find on the surface very sure supports, without risk of slipping, even in certain phases of the game where they are in a position close to loss of equilibrium.

Figure 4:
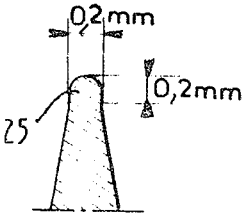
FIG. 4 is a view on an enlarged scale and in section of a crest line.

In FIG. 4, the crest line terminates in a rounded-off part 25, the largest dimension of which is 0.2 mm both in height and width.

While the playing surface is particularly useful for tennis courts, it is in no way restricted but can be used for other ball games, including basketball and badminton.

We claim:

1. A playing surface comprising; a plurality of distinct continguous elements the upper faces of which form the general plane of the surface, each of said elements having a plurality of side faces; coupling means comprising male parts and female parts arranged with male parts on some of said side faces and female parts on others of said side faces; each male part comprising a downwardly extending shank and a curved part projecting laterally therefrom; each female part comprising a loop projecting laterally from the respective side face and defining an opening which is perpendicular to the plane of the facing, said loop having a hook downwardly located therein with the shank capable of lateral play and the curved part caught below the loop.

2. An element for use in making a playing surface, said element comprising an upper face which forms the general plane of the facing and a plurality of side faces; coupling means on each of said side faces, said coupling means comprising male parts and female parts arranged with a male part on some of said side faces and a female part on the others of said side faces whereby a plurality of adjacent elements can be coupled together by connection of adjacent male and female parts; each male part comprising a downwardly extending hook having a shank and a curved part projecting laterally therefrom; each female part comprising a loop projecting laterally from the respective side face and defining an opening the axis of which is perpendicular to the plane of the facing, wherein the loop has an elastic membrane located adjacent to the side face and substantially perpendicular to the plane of the facing, said curved part of the hook being adapted to elastically deform the membrane during entry and engage below said membrane when adjacent elements are coupled.

3. An element according to claim 2, wherein the membrane extends from the edge of the side face from which the loop projects.

4. An element according to claim 2, wherein only the curved part of the hook projects from the side face on which the hook is located.

5. An element according to claim 2, wherein legs extend from the lower face and a part at least of one of the parts of the coupling means extends from the lower face along the same depth as the legs.

6. An element according to claim 2, wherein the largest dimension of each element does not exceed 20 cm.

7. An element according to claim 2, having a cellular structure, each cell having inclined walls which converge downwardly to define an aperture, adjacent walls of adjacent cells converging upwardly towards the top along lines which extend along the same intangible upper plane, the lines having a crest which is rounded.

8. An element according to claim 7, wherein the largest dimension of the rounded crests is not more than 0.4 mm.

9. An element according to claim 7, wherein the largest dimension of the rounded crests is between 0.2 mm and 0.4 mm.

10. An element according to claim 7, wherein the largest dimension between opposing walls of a cell is 10 mm.

11. An element according to claim 7, wherein the cells are hexagonal.

* * * * *

UNITED STATES PATENT OFFICE

CERTIFICATE OF CORRECTION

Patent No. 3,960,375 Dated June 1, 1976

Inventor(s) Albert Bibi-Roubi, et al

It is certified that error appears in the above-identified patent and that said Letters Patent are hereby corrected as shown below:

The term of this patent subsequent to June 1, 1993, has been disclaimed.'

Signed and Sealed this

Twelfth Day of October 1976

[SEAL]

*Attest:*

RUTH C. MASON
*Attesting Officer*

C. MARSHALL DANN
*Commissioner of Patents and Trademarks*